US007270697B2

(12) United States Patent
McAnespie

(10) Patent No.: US 7,270,697 B2
(45) Date of Patent: Sep. 18, 2007

(54) ELECTROSTATIC PRECIPITATOR

(75) Inventor: Donald I. McAnespie, Tecumseh (CA)

(73) Assignee: Durr Systems, Inc., Plymouth, MI (US)

( * ) Notice: Subject to any disclaimer, the term of this patent is extended or adjusted under 35 U.S.C. 154(b) by 42 days.

(21) Appl. No.: 11/247,618

(22) Filed: Oct. 11, 2005

(65) Prior Publication Data

US 2007/0079704 A1 Apr. 12, 2007

(51) Int. Cl.
*B03C 3/014* (2006.01)

(52) U.S. Cl. ..... 96/44; 55/DIG. 38; 95/65; 95/71; 95/75; 96/49; 96/50; 96/53; 96/98

(58) Field of Classification Search ..... 96/44–50, 96/52, 53, 98–100; 95/64–66, 71, 72, 75; 55/DIG. 38

See application file for complete search history.

(56) References Cited

U.S. PATENT DOCUMENTS 1,473,806 A * 11/1923 Bradley ..... 96/28
2,932,966 A * 4/1960 Grindell ..... 73/23.31
2,937,709 A * 5/1960 De Seversky ..... 96/45
2,956,640 A * 10/1960 Tuche et al. ..... 96/49
2,983,332 A * 5/1961 Vicard ..... 95/60
3,124,437 A * 3/1964 Lagarias ..... 95/75
3,578,997 A * 5/1971 Felici ..... 310/10
3,656,441 A * 4/1972 Grey et al. ..... 110/215
3,668,835 A * 6/1972 Vicard ..... 96/27
3,765,154 A * 10/1973 Hardt et al. ..... 96/88

* cited by examiner

*Primary Examiner*—Richard L. Chiesa
(74) *Attorney, Agent, or Firm*—Howard & Howard Attorneys, P.C.

(57) ABSTRACT

Electrostatic precipitators, including wet electrostatic precipitators, having a bank of conductive tubes which receive a gas stream having entrained particulates and an electrode connected to an electric current, wherein the tubes each include an internal restriction creating a hydrostatic pressure more evenly distributing the gas flow between the tubes eliminating the requirement for flow distribution devices, such as air straighteners and perforated plates.

20 Claims, 4 Drawing Sheets

ELECTROSTATIC PRECIPITATOR

FIELD OF THE INVENTION

This invention relates to electrostatic precipitators, particularly including wet electrostatic precipitators, wherein the electrostatic precipitator includes a bank of conductive tubes each having an inlet receiving a gas stream and an electrode extending axially in the tube connected to a source of electric current for removing particulates from the gas stream.

BACKGROUND OF THE INVENTION

Electrostatic precipitation has been a reliable technology for about 50 years used to abate smoke and to remove particulates from a waste gas stream. However, electrostatic precipitators are not effective in removing sticky particulate matter from air streams, such as the sticky particulate matter commonly in the waste gas stream in processes used by the wood industry and other industries. Wet electrostatic precipitators were developed for this application about 40 years ago. Electrostatic precipitators and wet electrostatic precipitators work on the principle of electrostatic charging of the particulates in the gas stream. Typically, a collector surface, commonly a bank of tubes, is maintained at positive electrical potential and an electrode is located axially in the tube or tubes connected to a source of electric current and maintained at a negative electrical polarity. A gas stream with entrained particulates is directed through the annular space between the positively charged tube and the negatively charged electrode, imparting a negative charge to the particulates and the particulates then drift toward the collection surface, usually the tube. Upon impacting the tube, the particle charge is released. Where the particles are sticky, however, the particles stick to the tube. To avoid fouling of the collection surface, the gas stream is saturated with a liquid mist, principally water, which collects on the internal surface of the tubes to create a continuous flowing film that keeps the particulate matter from fouling the tubes. Where the electrostatic precipitator includes saturating the gas stream with water, the apparatus is referred to as a wet electrostatic precipitator.

An important parameter in the performance of an electrostatic precipitator, particularly including a wet electrostatic precipitator, is the gas flow velocity through the tubes. A high gas velocity does not allow particulates sufficient time for the particles to migrate from the center of the annular space between the electrode and the internal surface of the tube to the internal tube wall. Therefore, a primary goal in the design of an electrostatic precipitator is to maintain an optimum uniform flow through each of the tubes of the tube bank. However, this is often very difficult to achieve in practice. To achieve more uniform flow distribution through the tubes, the prior devices have added various flow distribution devices, including "air straighteners" and perforated plates as described below. Obviously, these flow distribution devices add cost to the equipment and hinder accessibility to certain parts for maintenance and are susceptible to plugging because they are installed in the "dirty" air stream. Thus, an object of this invention is to eliminate flow distribution devices in the gas stream which contains particulates. Further objectives are reduced costs, improved efficiency and reduction in maintenance costs.

FIG. 1 illustrates one current embodiment of a wet electrostatic precipitator including flow distribution devices as described above. The embodiment of the wet electrostatic precipitator 20 shown in FIG. 1 includes an inlet chamber or inlet housing 22 having an inlet duct or tube 24 and a central outlet duct or tube 26 extend into the inlet chamber 22 having an open end 28 which directs the gas stream received by the inlet chamber 22 into a second chamber 30 as described further below. A bank 32 of conductive tubes 31 each have an open inlet end 34 which receives the gas stream from the second chamber 30. Each of the tubes 31 of the tube bank 32 further includes an outlet 36 which directs the stream of gas into an outlet chamber 38. A negatively charged electrode 40 extends axially into each of the tubes 31. In the disclosed embodiment, the electrodes 40 are supported on a high voltage grid 42 in the second chamber 30. A plurality of nozzles 44 intermittently spray liquid, typically water, into the second chamber 30 to wash away accumulated particulate matter from the insides of the tubes and flow distribution devices. In the disclosed embodiment, a plurality of nozzles 46 are also located in the inlet duct 24 to saturate the incoming gas stream.

As set forth above, wet electrostatic precipitators are utilized primarily for removal of sticky particulate matter from a gas stream, such as a waste gas stream from wood processing applications. The waste gas stream enters the inlet chamber 22 from the inlet duct 24. In the disclosed embodiment of the wet electrostatic precipitator 20 shown in FIG. 1, the inlet housing 22 is cylindrical and the outlet duct 26 is also cylindrical and extends axially into the cylindrical inlet housing 22. The inlet duct 24 in this embodiment is tangential to the cylindrical internal surface of the inlet housing 22 and offset from the axis of the outlet tube 26 to create a cyclonic effect of the gas stream within the inlet housing 22. The gas stream then flows through the open end 28 of the outlet tube 26 into the second chamber 30. The electrodes 40 in the conductive tubes 31 then impose a negative charge to the particulates in the gas stream and the particles then migrate to and collect on the positively charged internal surface of the tubes 31. The particulate matter is then washed through the tubes by the water which collects on the internal surfaces of the tubes 31 from the saturated waste gas stream. As will be understood by those skilled in this art, a wet electrostatic precipitator of the type shown in FIG. 1 may be used independently to remove sticky particulate matter from a waste gas stream or used in combination with other pollution abatement equipment, such as a regenerative thermal oxidizer to remove, for example, volatile organic compounds.

As further set forth above, an object of designers of wet electrostatic precipitators is to maintain a uniform flow through each of the tubes 31 of the tube bank 32. To achieve this object, the wet electrostatic precipitators now include various flow distribution devices, as shown in FIG. 1. In the disclosed embodiment, the outlet tube 26 includes a plurality of radial paddles 48, commonly referred to as "air straighteners." The purpose of the air straighteners 48 is to provide substantially straighten the flow through the outlet tube 26 into the second chamber 30 to promote more uniform distribution of the air stream through the tubes 31. Further, the disclosed embodiment of FIG. 1 includes perforated plates 50 and 52 adjacent to and at the outlet of the outlet tube 26. In this embodiment, the outlet 54 of the outlet tube 26 is frustoconical. In a typical application, the perforated plates 50 and 52 include a plurality of equally spaced holes having a diameter of 3.125 inches on 3.5 inch centers. A third perforated plate 56 is provided in the second chamber opposite the outlet 54 of the outlet tube 26. In a typical application, the third perforated plate includes a plurality of equally spaced holes or perforations having a diameter of 2.625 inches having center spacing of 3.5 inches. As will be understood by those skilled in this art, the purpose of the perforated plates 50, 52 and 56 are to spread the flow of the gas stream received in the second chamber 30 and equalize the flow through the tubes 31 of the tube bank 32. However, the flow distribution devices, particularly including the perforated plates 50, 52 and 56, collect particulate matter requiring frequent cleaning and maintenance and the air straighteners 48 and perforated plates 50, 52 and 56 add to the cost of the wet electrostatic precipitator.

Further, the flow distribution devices presently used, as shown in FIG. 1, do not evenly distribute air flow through the tubes 31 as shown by FIG. 2. FIG. 2 is a graph plotting the volume of flow through the tubes 31 of FIG. 1 in standard cubic feet per minute across the tube bank 32. As shown by FIG. 2, even with the flow distribution devices described above with reference to FIG. 1, the flow through the central tubes is significantly less than the flow through the tubes at the outer periphery of the tube bank. As described above, this maldistribution of air flow through the tubes 31 results in reduced efficiency of the electrostatic precipitator 20, wherein a greater velocity through the tubes does not allow particulate matter enough time to migrate from the center of the annular space between the electrode 40 and the inner surface of the tubes 31 and a very slow velocity reduces the throughput of the electrostatic precipitator. Thus, an object of any electrostatic precipitator is to have substantially uniform flow of the gas stream through the tubes 31 of the tube bank 32. It will also be understood that the flow distribution devices will also hinder the accessibility of certain parts of the electrostatic precipitator for maintenance or replacement.

The electrostatic precipitator of this invention eliminates the requirement for flow distribution devices, including air straighteners 48 and perforated plates 50, 52 and 56, while providing substantially uniform flow through the tubes at an appropriate volume to provide optimal precipitation of the particulates as now described.

SUMMARY OF THE INVENTION

The disclosed embodiment of the electrostatic precipitator of this invention for removal of particulates from a gas stream includes an inlet chamber receiving the gas stream and directing the gas stream into a second chamber, and a bank of conductive tubes each having an inlet in the second chamber, an electrode extending into the tubes connected to a source of electric current, wherein the tubes each include an internal restriction creating a hydrostatic pressure which balances the flow between the tubes of the tube bank. However, the electrostatic precipitator of this invention may include only one chamber, which would be the inlet chamber and the bank of conductive tubes would then receive the gas stream directly from the inlet chamber. In a preferred embodiment of the electrostatic precipitator of this invention, the internal restriction in the tubes creates a pressure drop of between 0.1 and three inches of water, more preferably a pressure drop of between 0.1 inches and one inch of water and most preferably between 0.1 and 0.3 inches of water or an optimal pressure drop of about 0.25 inches of water. As described below, the internal restriction in the tubes may take various forms. For example, in one preferred embodiment, a frustoconical depression is formed in the tubes having a minor diameter at the center of the tube, which is simple and inexpensive to form. Other embodiments include an end wall or an internal wall extending generally perpendicular to the axis of the tube having an opening through the end wall or internal wall to create a hydrostatic pressure. Other embodiments include venturi-type restrictions which may be integrally formed in the tube or a separate conical restriction within the tube. The preferred restriction will also depend upon the air flow through the electrostatic precipitator, the application of the electrostatic precipitator and other factors.

Where the electrostatic precipitator of this invention is utilized to remove certain particulates requiring a wet electrostatic precipitator, such as sticky particulate material found in the waste stream of certain processes including, for example, the waste gas stream from wood processing applications, the preferred embodiment of the electrostatic precipitator further includes a nozzle or more preferably a plurality of nozzles injecting liquid droplets or a fine mist of liquid, such as water, into the waste gas stream prior to receipt of the gas stream into the tube bank. In one preferred embodiment of the wet electrostatic precipitator of this invention, a plurality of nozzles inject a fine mist of water into the second chamber. In another preferred embodiment of the wet electrostatic precipitator of this invention, a plurality of nozzles inject a fine mist of water into the inlet tube or inlet duct of the inlet chamber, saturating the incoming gas stream.

As will be understood by those skilled in this art, this invention may be utilized with any electrostatic precipitator, particularly including wet electrostatic precipitators, such as the wet electrostatic precipitator 20 illustrated in FIG. 1. In this embodiment, the electrostatic precipitator includes an inlet chamber having a cylindrical internal surface, an axial outlet tube extending into the inlet chamber, an inlet duct or tube offset from the axis of the outlet tube to generate a cyclonic gas stream within the inlet chamber and wherein the outlet tube includes an open end directing the gas stream into a second chamber and the bank of conductive tubes each have an open end receiving the gas flow from the second chamber. Various modifications may be made to the electrostatic precipitator of this invention within the purview of the appended claims and the following description of a preferred embodiment is intended for illustrative purposes only.

DESCRIPTION OF A PREFERRED EMBODIMENT

Figure 1:
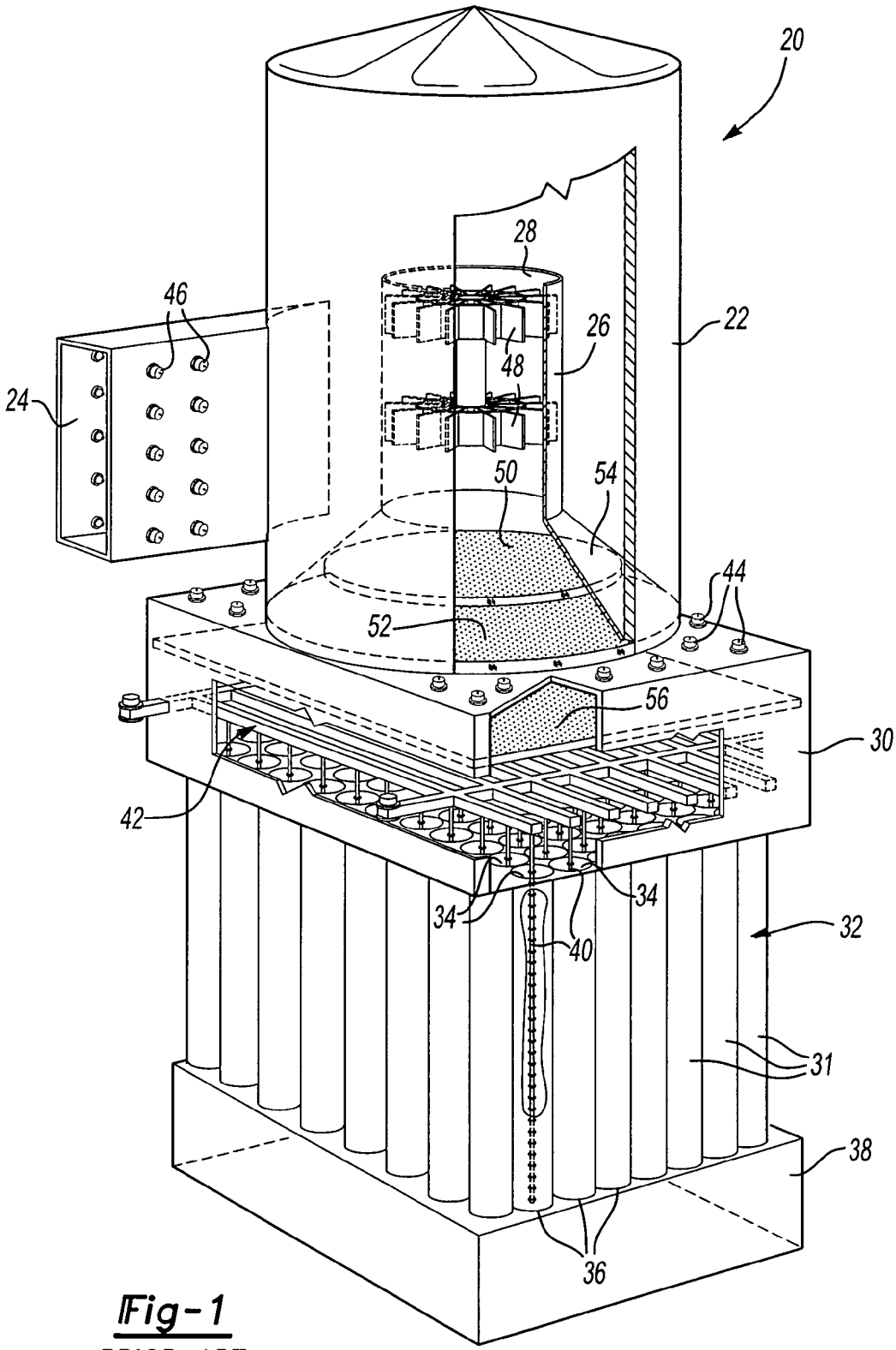
Fig-1 PRIOR ART
FIG. 1 is a side perspective view partially cross-sectioned of a conventional or prior art wet electrostatic precipitator.

As set forth above, this invention may be utilized with any electrostatic precipitator, particularly including wet electrostatic precipitators of the type illustrated in FIG. 1. However, as set forth herein, this invention may be utilized with any conventional electrostatic precipitator or wet electrostatic precipitator and thus the disclosed embodiment of the wet electrostatic precipitator of this invention is for illustrative purposes only. For ease of description and because the disclosed embodiment of the wet electrostatic precipitator of this invention is based upon the design of the wet electrostatic precipitator 20 illustrated in FIG. 1, the common elements of the embodiment of the wet electrostatic precipitator 120 illustrated in FIG. 3 are numbered in the same sequence as the wet electrostatic precipitator 20 illustrated in FIG. 1 plus 100.

Figure 3:
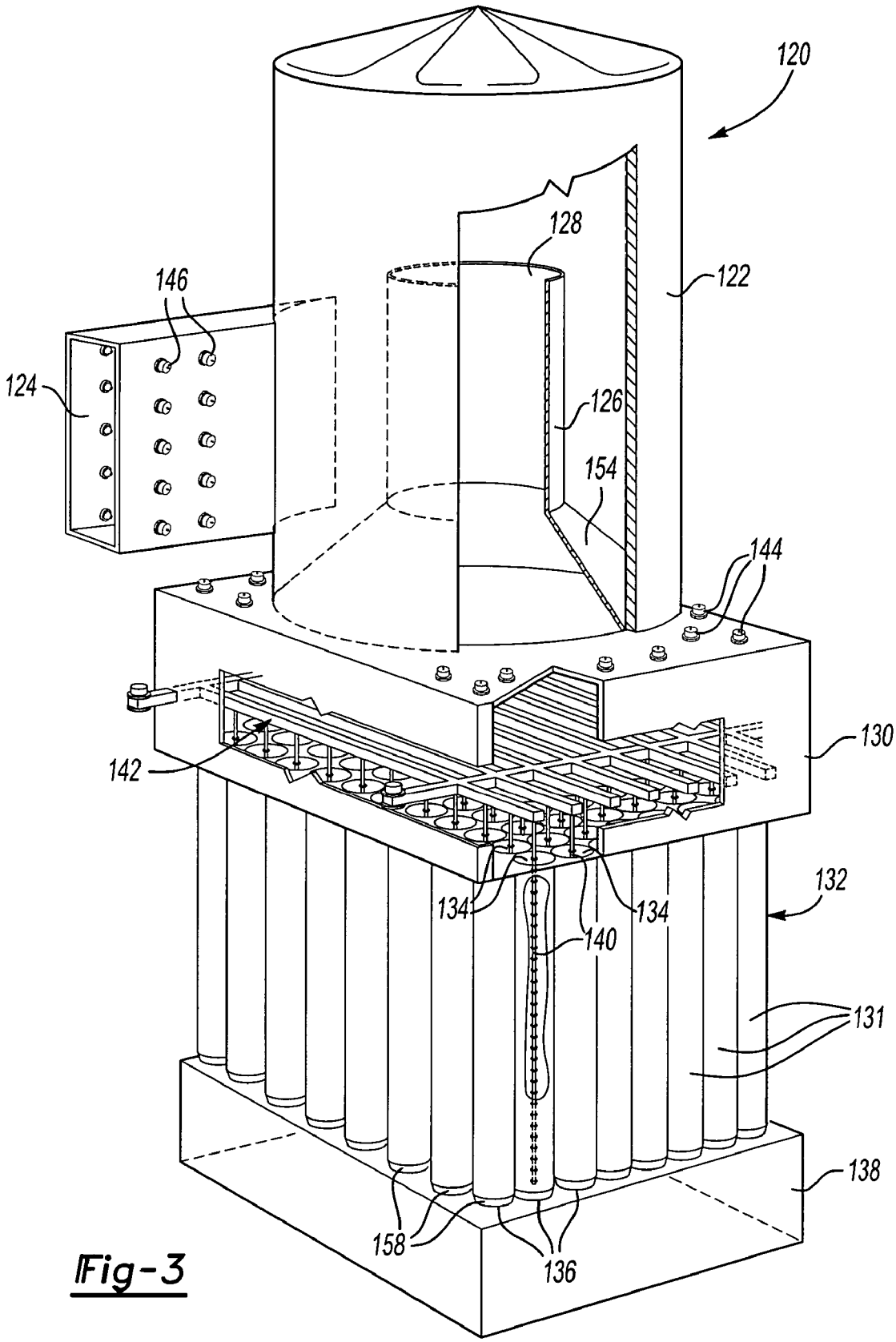
FIG. 3 is a side perspective view of one embodiment of a wet electrostatic precipitator of this invention.

As described above with regard to the wet electrostatic precipitator shown in FIG. 1, the disclosed embodiment of the wet electrostatic precipitator 120 shown in FIG. 3 includes an inlet chamber 122 having an inlet duct 124 and a central or axial outlet tube 126 which extends into the inlet chamber 122 as shown in FIG. 3. The inlet duct 124 in this embodiment is offset or tangential to the cylindrical internal surface of the inlet housing 122 and offset from the axis of the outlet tube 126 creating a cyclonic effect of the gas stream in the inlet housing 122. The outlet tube 126 includes an open end 128 which directs the gas stream into the second chamber 130. However, a preferred embodiment of the wet electrostatic precipitator 120 of this invention does not include flow distribution devices, such as the air straighteners 48 and the perforated plates 50, 52 and 56 shown in FIG. 1. As set forth below, the wet electrostatic precipitator 120 of this invention nevertheless provides more uniform distribution of the gas stream through the conductive tubes and thus improved efficiency at reduced cost and reduced maintenance.

The disclosed embodiment of the wet electrostatic precipitator 120 of this invention further includes a bank of conductive tubes 132, wherein each of the conductive tubes 131 include an inlet 134 receiving the gas stream from the second chamber 130. As used herein, the terms bank of conductive tubes or tube bank means a plurality of tubes or pipes arranged in generally parallel relation, which may be nested as shown in FIGS. 1 and 3, or otherwise arranged such that the gas flow including particulates is received through the tubes rather than around the tubes. The tubes 131 may be cylindrical as shown or polygonal for example and are preferably concentric around a longitudinal axis. As set forth above with regard to FIG. 1, the wet electrostatic precipitator 120 of this invention further includes electrodes 140 which extend into and substantially through the conductive tubes 131 supported on a high voltage grid 142. As will be understood by those skilled in this art, the high voltage grid 142 is connected to a source of electric current (not shown) to create an electric field between the electrodes 140 and the conductive tubes 131, thereby causing precipitation of the particulate matter in the gas stream on the internal surface of the tubes. In the disclosed embodiment of the wet electrostatic precipitator 120 of this invention, the second chamber or housing 130 includes a plurality of nozzles 144 which inject a fine mist of water or other liquid carrier to saturate the gas stream and remove particulate matter from the internal surface of the conductive tubes 131. In this embodiment, the inlet duct 124 of the inlet housing 122 further includes a plurality of nozzles 146 which inject a fine mist of water or other carrier liquid into the inlet gas stream. As will thus be understood, in the wet electrostatic precipitator of this invention, nozzles in the inlet 124 are for saturating the incoming air whereas a second of nozzles second chamber 130 is for washing away accumulated particulate matter. These nozzles are activated intermittently. Further, the frustoconical outlet 154 of the outlet tube 126 is optional, although the frustoconical outlet 154 does have the advantage of slowing the gas stream in the second chamber 130.

Figure 5:
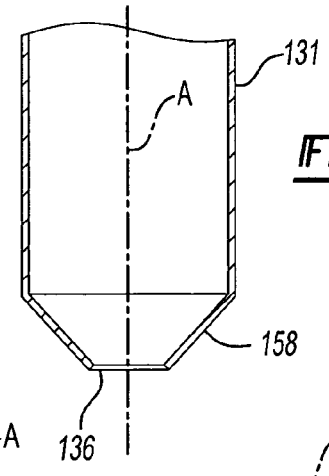
FIG. 5 is a side cross-sectional view of one embodiment of an internal restriction in the tubes of the tube bank of the wet electrostatic precipitator illustrated in FIG. 3.

As set forth above, in the preferred embodiment of the electrostatic precipitator of this invention, the conductive tubes 131 of the tube bank 132 includes an internal restriction which creates a hydrostatic pressure within the tubes, balancing the gas flow through the tubes 131 of the tube bank 132. In a preferred embodiment, the internal restrictions in the tubes 131 create a pressure drop of between 0.1 to 3 inches of water or more preferably 0.1 inches to one inch of water or most preferably between 0.1 and 0.3 inches of water or an optimum pressure drop of about 0.025 inches of water. As set forth above, the configuration of the internal restriction of the tubes may take several forms, but is preferably concentric with the longitudinal axis of the tubes and provide a uniform pressure drop within the stated ranges within each of the tubes. In the embodiment of the wet electrostatic precipitator 120 shown in FIG. 3, the tubes 131 each include a frustoconical restriction 158 concentric with the axis A of the tubes as best shown in FIG. 5. In this embodiment, the frustoconical restriction 158 is located at the outlet 136 of the tubes 131. This is a preferred embodiment because the frustoconical restriction 158 is easily and accurately formed on the tubes 131 and provides a more uniform flow through the tubes 131.

Figure 6A:
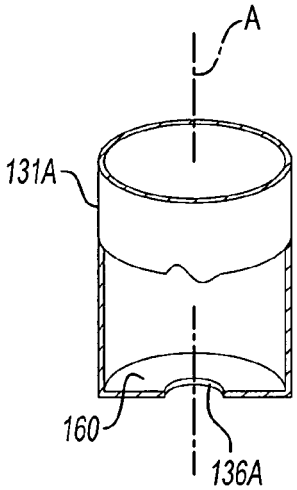
FIGS. 6A to 6E are alternative embodiments of internal restrictions in the tubes of the tube bank of the wet electrostatic precipitator illustrated in FIG. 3.
Figure 6B:
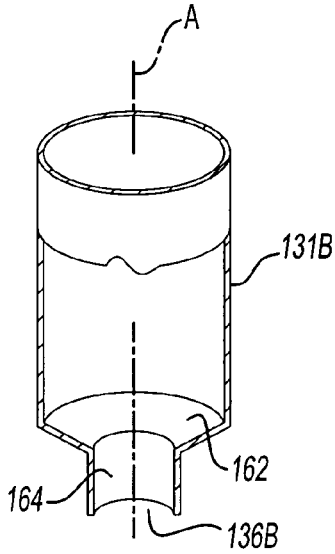
Figure 6C:
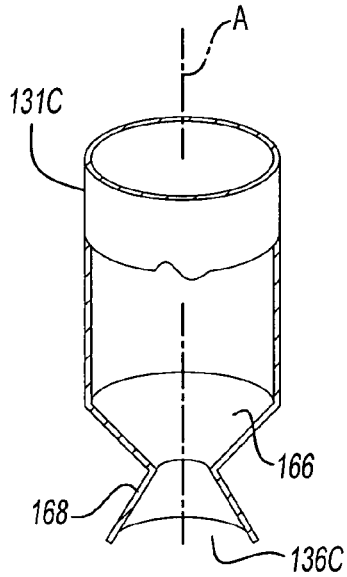

In the embodiment shown in FIG. 6A, the internal restriction 160 in the tubes 131A extends generally perpendicular to the longitudinal axis A and is also located adjacent the open end 136A of the tubes 131A. This embodiment is also simple to form and provides an increased pressure drop which may be desirable for some applications of the wet electrostatic precipitator 120. In the embodiment of the tubes 131B shown in FIG. 6B, the internal restriction includes a frustoconical portion 162 and a tubular portion 164 adjacent the open end 136 of the tubes 131B. This embodiment provides more laminar flow of the gas stream. As shown in FIG. 6B, the frustoconical portion 162 and the tubular portion 164 are concentric with the axis A of the tubes 131B. In the embodiment of the tubes 131C shown in FIG. 6C, the internal restriction includes an inwardly formed frustoconical portion 166 and an opposed outwardly flared frustoconical portion 168, creating a venturi-type effect to the gas stream. In the embodiment of the conductive tubes 131D shown in FIG. 6D, a separate conical insert 170 is supported by brackets 172 within the tubes 131D adjacent the outlet 136D, also creating a venturi-type effect. Finally, in the embodiment of the conductive tubes 131E shown in FIG. 6E, the tubes include a separate internal restrictor 174 having an opening 176 coaxially aligned with the longitudinal of the tube A.

Figure 6D:
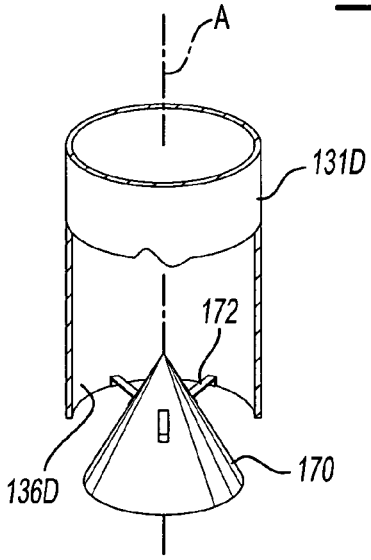
Figure 6E:
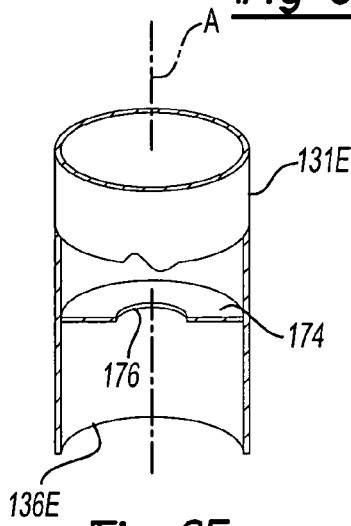

As will be understood from the description of the embodiments of the internal restriction in the tubes shown in FIGS. 5 and 6A to 6E, the internal restriction may be formed integrally with the tubes as shown in FIGS. 5 and 6A to 6C. However, the internal restriction may also be separately formed and inserted into the tubes as shown in FIGS. 6D and 6E. In a preferred embodiment, the internal restriction is located at or adjacent the end of the air flow path, which is the lower end of the tubes in the embodiment of the wet electrostatic precipitator 120 shown in FIG. 3. However, as will be understood by those skilled in this art, this invention may also be utilized for electrostatic precipitators having an up flow through the conductive tubes, in which case the internal restriction is preferably provided at the top of the tubes.

Having described one preferred embodiment of a wet electrostatic precipitator 120 of this invention, the operation of the wet electrostatic precipitator will now be briefly described. A gas stream, such as a waste gas stream containing sticky particulate matter is received in the inlet housing 122 through the inlet duct or tube 124. Because in this embodiment, the internal surface of the inlet housing or chamber 122 is cylindrical and the inlet duct 124 is generally tangential to the internal cylindrical surface and offset from the outlet tube 126, the gas stream creates a swirls in the inlet chamber 122 around the outlet tube 126, creating a cyclonic effect within the inlet housing 122 as described above. The gas stream is then received in the open end 128 of the outlet tube 126 and directed into the second chamber 130. The gas stream is then directed into the open ends or inlets 134 of the tubes 131 of the tube bank 132. The gas stream is then distributed between the conductive tubes 131 of the tube bank 132 and directed through the annular space between the internal surface of the tubes 131 and the electrodes 140 where the particulate matter entrained in the gas stream migrates to the internal surface of the tubes 131 and is washed from the internal surface by the water or other liquid carrier entrained in the gas stream by injecting a liquid mist into the second chamber 130 and/or the inlet chamber 124.

Figure 2:
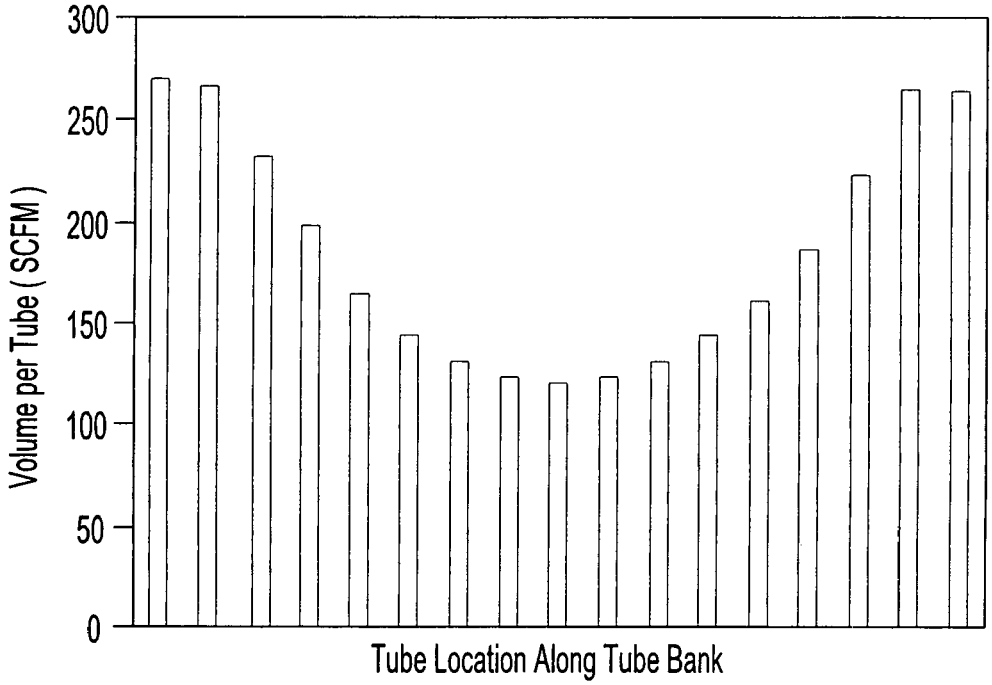
Fig-2 PRIOR ART
FIG. 2 is a graph of the volume of gas flow through the tubes plotted against the tube location along the tube bank of the wet electrostatic precipitator illustrated in FIG. 1.
Figure 4:
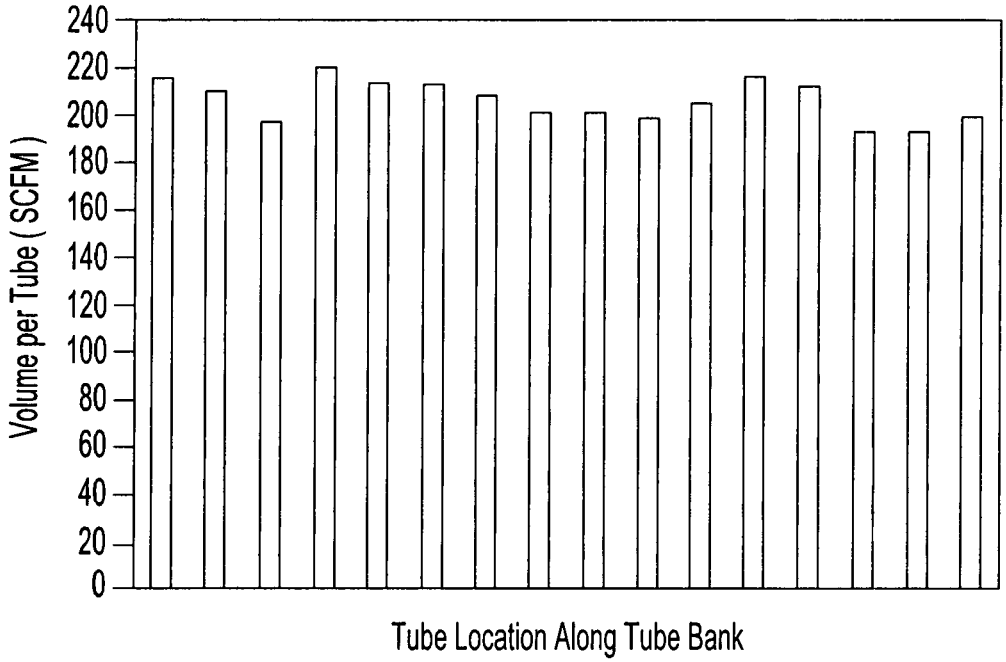
FIG. 4 is a graph of the volume of gas flow through the tubes plotted against the tube location along the tube bank of the wet electrostatic precipitator illustrated in FIG. 3. This results shown in this graph are for a wet electrostatic precipitator without the optional frustoconical element 154.

An important advantage of the wet electrostatic precipitator 120 of this invention is shown by the graph of FIG. 4. FIG. 4 is a graphical representation of the volume gas flow per tube in standard cubic feet per minute plotted against the tube location along or across the tube bank. As shown in FIG. 4, the volume flow of the gas stream through each of the tubes 131 are substantially uniform, particularly as compared to the gas flow through the tubes in the prior art wet electrostatic precipitator illustrated in FIG. 1 which includes flow distribution devices, including the air straighteners 48 and the perforated plates 50, 52 and 56. It should also be noted that the volume or gas flow rate through the tubes plotted in FIG. 4 has a more detailed scale than FIG. 2. Thus, the internal restrictions in the tubes 131 provide a significantly more even distribution of the gas stream between the tubes 131 than the flow distribution devices of the wet electrostatic precipitator illustrated in FIG. 1. As set forth above, elimination of the flow distribution devices also has other important advantages. The flow distribution devices, particularly including the perforated plates 50, 52 and 56 are located in the "dirty air" zone of the wet electrostatic precipitator 20 and therefore collect particulate matter which requires cleaning and maintenance. Second, the flow distribution devices add expense to the wet electrostatic precipitator and therefore the electrostatic precipitator of this invention reduces the cost of such devices. Even with increased pressure drop across the internal restriction, the overall pressure drop across the wet electrostatic precipitator 120 is lower than that across 20 thereby reducing the operating cost. Further, because the electrostatic precipitator of this invention provides more uniform flow through the electrostatic tubes, the apparatus is more efficient than the prior art. Finally, as set forth above, the flow distribution devices used with the prior art also interfere with maintenance or replacement of components of the electrostatic precipitator.

Having described one preferred embodiment of a wet electrostatic precipitator of this invention, it will be understood that various modifications may be made to the disclosed embodiment within the purview of the appended claims. As set forth above, this invention may be utilized with any type of electrostatic precipitator or wet electrostatic precipitator to achieve more uniform flow through the conductive tubes, improve efficiency and reduce cost, including maintenance cost. As will be understood by those skilled in this art, there are numerous types of electrostatic precipitators and wet electrostatic precipitators in the market. As set forth above, the conductive tubes 131 may be cylindrical as shown in the figures or polygonal, including hexagonal, octagonal, etc. Further, the second chamber 30 may be eliminated, such that the bank of conductive tubes 32 receives the gas stream directly from the inlet chamber 22. The invention disclosed herein may also be utilized with conventional electrostatic precipitators. However, this invention is particularly suitable for wet electrostatic precipitators as disclosed herein. The invention is now claimed, as follows.

The invention claimed is:

1. An electrostatic precipitator for removal of particulates from a gas stream, comprising:

an inlet chamber receiving a gas stream including particulates; and a bank of conductive tubes, said conductive tubes being concentric with a longitudinal axis, each having an inlet receiving the gas stream, an outlet and an electrode extending in said longitudinal axis in said tubes connected to a source of electric current removing particulates from said gas stream, and each of said tubes including an internal restriction creating a hydrostatic pressure balancing the gas flow through said tubes of said bank of tubes.

2. The electrostatic precipitator as defined in claim 1, wherein said internal restriction of said tubes creates a pressure drop of between 0.1 to three inches of water.

3. The electrostatic precipitator as defined in claim 1, wherein said internal restriction in said tubes creates a pressure drop of between 0.1 inches and one inch of water.

4. The electrostatic precipitator as defined in claim 1, wherein said internal restriction of said tubes creates a pressure drop of between 0.1 and 0.3 inches of water.

5. The electrostatic precipitator as defined in claim 1, wherein said inlet chamber includes a cylindrical internal surface, a central outlet tube extending into said inlet chamber and an inlet of said inlet chamber offset from an axis of said central outlet tube creating a cyclonic effect within said inlet chamber.

6. The electrostatic precipitator as defined in claim 1, wherein said inlet chamber includes a nozzle spraying a liquid mist into the gas stream received in said inlet chamber.

7. The electrostatic precipitator as defined in claim 1, wherein said inlet chamber includes a plurality of nozzles spraying water into the gas stream received in said inlet chamber.

8. The electrostatic precipitator as defined in claim 1, wherein said internal restriction includes a frustoconical portion having a minor diameter extending into said tubes creating a pressure drop of between 0.1 and three inches of water.

9. The electrostatic precipitator as defined in claim 1, wherein said internal restriction is integral with said tubes.

10. The electrostatic precipitator as defined in claim 1, wherein said internal restriction is adjacent said outlet of said tubes.

11. A wet electrostatic precipitator for removal of particulates from a gas stream, comprising:

an inlet chamber receiving a gas stream including particulates and an outlet;

a nozzle injecting liquid droplets into said gas stream; and a bank of conductive tubes each having a longitudinal axis and an internal surface concentric with said longitudinal axis, an inlet receiving said gas stream, an electrode extending axially in said tubes connected to a source of electric current removing particulates from said gas stream, an outlet and each of said tubes having an internal restriction creating a hydrostatic pressure and a pressure drop of between 0.1 to three inches of water in said tube, balancing gas flow through said tubes of said bank of tubes.

12. The wet electrostatic precipitator as defined in claim 11, wherein said internal restriction of said tubes creates a pressure drop of between 0.1 inches and one inch of water.

13. The wet electrostatic precipitator as defined in claim 11, wherein said internal restriction of said tubes creates a pressure drop of between 0.1 and 0.3 inches of water.

14. The wet electrostatic precipitator as defined in claim 11, wherein said inlet chamber includes a cylindrical internal surface, a central cylindrical tube extending into said inlet chamber defining said outlet and an inlet of said inlet chamber offset from said axis of said central tube creating a cyclonic gas effect within said inlet chamber.

15. The wet electrostatic precipitator as defined in claim 11, wherein said inlet chamber includes a plurality of nozzles injecting a fine mist of water into said gas stream.

16. The wet electrostatic precipitator as defined in claim 11, wherein said internal restriction of said tubes each includes a frustoconical portion having a minor diameter extending into said tubes creating a hydrostatic pressure and balancing flow through said bank of tubes.

17. The wet electrostatic precipitator as defined in claim 11, wherein said internal restriction is integral with said tubes.

18. The wet electrostatic precipitator as defined in claim 11, wherein said internal restriction is adjacent said outlet of said tubes.

19. A wet electrostatic precipitator for removal of particulates from a gas stream, comprising:

an inlet chamber including a cylindrical internal surface, an outlet tube extending into said inlet chamber directing a gas stream from said inlet chamber into a second chamber, and an inlet receiving a gas stream including particulates offset from an axis of said outlet tube creating a cyclonic effect within said inlet chamber without any restrictions to gas flow within said inlet chamber, and one of said inlet and outlet chambers including a nozzle directing a liquid mist into said gas stream; and a bank of conductive tubes each having a longitudinal axis and an internal surface concentric with said longitudinal axis, each of said tubes of said bank of conductive tubes including an inlet receiving said gas stream from said second chamber, an electrode extending axially in said tubes connected to a source of electric current removing particulates from said gas stream, each of said tubes having an outlet and an internal restriction creating hydrostatic pressure and a pressure drop of between 0.1 and three inches of water, thereby balancing flow between said tubes of said bank of tubes.

20. The wet electrostatic precipitator as defined in claim 19, wherein said restriction in said tubes creates a pressure drop of between 0.1 and 0.3 inches of water.

* * * * *